US009118114B2

(12) United States Patent
Kagaya et al.

(10) Patent No.: US 9,118,114 B2
(45) Date of Patent: Aug. 25, 2015

(54) WINDOW GLASS FOR VEHICLE AND ANTENNA

(71) Applicant: ASAHI GLASS COMPANY, LIMITED, Tokyo (JP)

(72) Inventors: Osamu Kagaya, Tokyo (JP); Kotaro Suenaga, Tokyo (JP); Koji Ikawa, Tokyo (JP)

(73) Assignee: ASAHI GLASS COMPANY, LIMITED, Tokyo (JP)

( * ) Notice: Subject to any disclaimer, the term of this patent is extended or adjusted under 35 U.S.C. 154(b) by 254 days.

(21) Appl. No.: 13/904,589

(22) Filed: May 29, 2013

(65) Prior Publication Data

US 2013/0257664 A1 Oct. 3, 2013

Related U.S. Application Data

(63) Continuation of application No. PCT/JP2011/077090, filed on Nov. 24, 2011.

(30) Foreign Application Priority Data

Nov. 30, 2010 (JP) ..... 2010-267532

(51) Int. Cl.

| | |
|---|---|
| ***H01Q 1/32*** | (2006.01) |
| ***H01Q 1/12*** | (2006.01) |
| ***H01Q 7/00*** | (2006.01) |

(Continued)

(52) U.S. Cl.

CPC ..... *H01Q 1/3291* (2013.01); *H01Q 1/1271* (2013.01); *H01Q 1/22* (2013.01); *H01Q 7/00* (2013.01); *H01Q 13/10* (2013.01)

(58) Field of Classification Search

CPC ..... H01Q 1/1271; H01Q 1/3291; H01Q 1/22; H01Q 7/00; H01Q 13/10

USPC ..... 343/713, 712, 711

See application file for complete search history.

(56) References Cited

U.S. PATENT DOCUMENTS

| | | | | |
|---|---|---|---|---|
| 5,005,020 | A * | 4/1991 | Ogawa et al. | 343/713 |
| 5,012,255 | A | 4/1991 | Becker | |

(Continued)

FOREIGN PATENT DOCUMENTS

| | | |
|---|---|---|
| EP | 1 108 616 A2 | 6/2001 |
| JP | H2-082701 | 3/1990 |

(Continued)

OTHER PUBLICATIONS

International Search Report PCT/JP2011/077090 dated Feb. 28, 2012.

(Continued)

*Primary Examiner* — Hoanganh Le
(74) *Attorney, Agent, or Firm* — Foley & Lardner LLP

(57) ABSTRACT

Window glass for vehicle may include an antenna conductor having electrodes provided on a surface of a dielectric on a side opposite from a conductive film. The conductive film may include a slot with a first end part that opens at a peripheral edge part of the conductive film. The antenna conductor may include a loop-shaped antenna element which electrodes serve as a feeding point, and projections of the electrodes onto a glass plate are located at positions not overlapping the conductive film, and a projection of the loop-shaped antenna element onto the glass plate forms a crossover part that crosses the slot.

20 Claims, 8 Drawing Sheets

(51) Int. Cl.
*H01Q 13/10* (2006.01)
*H01Q 1/22* (2006.01)

(56) References Cited

U.S. PATENT DOCUMENTS

| | | | | | |
|---|---|---|---|---|---|
| 5,355,144 | A | | 10/1994 | Walton et al. | |
| 5,898,407 | A | | 4/1999 | Paulus et al. | |
| 6,018,322 | A | * | 1/2000 | Taniguchi et al. | 343/713 |
| 6,097,345 | A | * | 8/2000 | Walton | 343/769 |
| 6,211,832 | B1 | | 4/2001 | Endo et al. | |
| 6,317,090 | B1 | * | 11/2001 | Nagy et al. | 343/713 |
| 6,320,276 | B1 | | 11/2001 | Sauer | |
| 2010/0231468 | A1 | | 9/2010 | Ogino et al. | |
| 2012/0154229 | A1 | * | 6/2012 | Kagaya et al. | 343/713 |

FOREIGN PATENT DOCUMENTS

| | | | |
|---|---|---|---|
| JP | H3-196704 | | 8/1991 |
| JP | H3-204202 | | 9/1991 |
| JP | H6-045817 | | 2/1994 |
| JP | H9-175166 | | 7/1997 |
| JP | 2000-059123 | A | 2/2000 |
| JP | 2000-114839 | A | 4/2000 |
| JP | 2001-185928 | A | 7/2001 |
| WO | WO 2010/047214 | A1 | 4/2010 |

OTHER PUBLICATIONS

Extended European Search Report dated May. 20, 2015 issued in application 11846039.3.

* cited by examiner

WINDOW GLASS FOR VEHICLE AND ANTENNA

CROSS-REFERENCE TO RELATED APPLICATIONS

This application is a continuation application filed under 35 U.S.C. 111(a) claiming the benefit under 35 U.S.C. 120 and 365(c) of a PCT International Application No. PCT/JP2011/077090 filed on Nov. 24, 2011, which is based upon and claims the benefit of priority of the prior Japanese Patent Application No. 2010-267532 filed on Nov. 30, 2010, the entire contents of which are incorporated herein by reference.

BACKGROUND OF THE INVENTION

1. Field of the Invention

The present invention relates to window glass for vehicle, having an antenna that utilizes a conductive film provided on a glass plate, and to the antenna utilizing the conductive film.

2. Description of the Related Art

FIG. 1 is a cross sectional view illustrating window glass for vehicle, having a conductive film 3 and an intermediate film 4 interposed between glass plates 1 and 2. In FIG. 1, an arrow D1 indicates a vehicle exterior side, and an arrow D2 indicates a vehicle interior side. Conventionally, in a case in which an antenna conductor 5 for receiving radio waves is formed on the vehicle interior side D2 of the glass plate 2 of the laminated glass, the radio waves arriving from the vehicle exterior side D1 may be blocked by the conductive film 3, and it may be difficult to sufficiently obtain a reception characteristic required of the antenna conductor 5.

In order to eliminate such inconvenience, known window glass may have an antenna function by utilizing a conductive film (for example, refer to Japanese Laid-Open Patent Publications No. 6-45817, No. 9-175166, and No. 2000-59123, and U.S. Pat. No. 5,012,255).

The Japanese Laid-Open Patent Publications No. 6-45817, No. 9-175166, and the U.S. Pat. No. 5,012,255 propose a slot antenna that utilizes a slot between the conductive film and a flange of a vehicle body to which the glass plate is fixed. In the case of the slot antenna that utilizes the slot between the conductive film and the flange of the vehicle body, the size of the slot is determined for each vehicle model, and it is difficult to cause resonance at a predetermined frequency, specifically, in order to receive radio waves in a high frequency band. Further, in order to receive radio waves in a high frequency band, a positional relationship of the flange and the conductive film needs to be accurately controlled. However, because there are differences among individual glass plates and the glass plate is fixed to the flange of the vehicle body by an adhesive, various errors may be generated in the adhesive thickness, the fixing position of the glass plate with respect to the flange, and the like. Accordingly, there is a problem in that it is difficult to form slots of identical sizes in mass production.

In addition, when a slot is provided in the conductive film in addition to the slot between the conductive film and the flange of the vehicle body as in the case of the U.S. Pat. No. 5,012,255, the effects of the conductive film may deteriorate when the additional slot is large, and there is a problem in that, when the glass plate is bent and formed by heating, a large heat distribution is generated on the glass plate depending on the existence of the conductive film, to thereby deteriorate the forming accuracy.

SUMMARY OF THE INVENTION

Accordingly, embodiments of the present invention may provide window glass for vehicle, such as automotive glass, utilizing a conductive film, and an antenna, that enable operation at a predetermined frequency regardless of the size of a slot between the conductive film and a flange of a vehicle body, and does not require accuracy in setting a glass plate to the flange of the vehicle body.

According to one aspect of the present invention, window glass for vehicle may include a glass plate, a dielectric, a conductive film arranged between the glass plate and the dielectric, and an antenna conductor having electrodes provided on a surface of the dielectric on a side opposite from the conductive film, wherein the conductive film is formed with a slot having a first end part that opens at a peripheral edge part of the conductive film, the antenna conductor includes a loop-shaped antenna element which the electrodes serve as a feeding point, wherein projections of the electrodes on a side of the glass plate are located at positions not overlapping the conductive film, and a projection of the loop-shaped antenna element on the side of the glass plate forms a crossover part that crosses the slot.

According to another aspect of the present invention, an antenna may include a glass plate, a dielectric, a conductive film arranged between the glass plate and the dielectric, and an antenna conductor having electrodes provided on a surface of the dielectric on a side opposite from the conductive film, wherein the conductive film is formed with a slot having a first end part that opens at a peripheral edge part of the conductive film, the antenna conductor includes a loop-shaped antenna element which the electrodes serve as a feeding point, projections of the electrodes on a side of the glass plate are located at positions not overlapping the conductive film, and a projection of the loop-shaped antenna element on the side of the glass plate forms a crossover part that crosses the slot.

DESCRIPTION OF THE PREFERRED EMBODIMENTS

Figure 1:
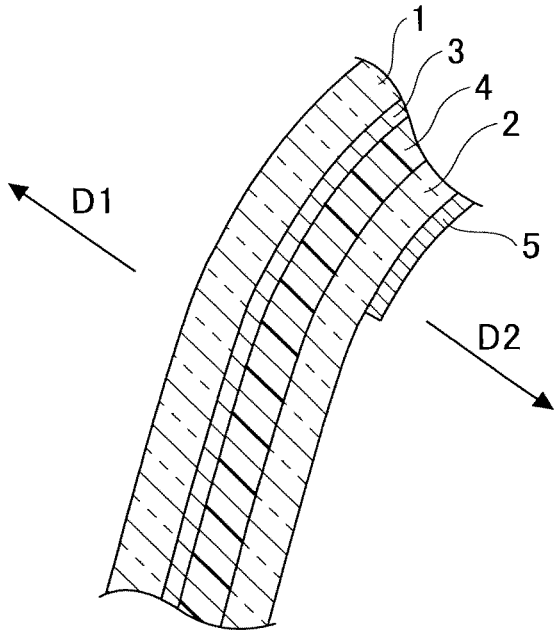
FIG. 1 is a cross sectional view illustrating window glass for vehicle, having a conductive film 3 and an intermediate film 4 interposed between glass plates 1 and 2.

A description will hereinafter be given of embodiments of the present invention with reference to the drawings. In the drawings used to describe the embodiments, directions refer to the directions in the figures unless otherwise indicated, and reference directions in the figures correspond to the directions indicated by symbols or reference numerals. In addition, directions that are parallel, perpendicular, and the like may tolerate an error to a certain extent that does not impair the effects of the embodiments. Further, the embodiments may be applied to a windshield mounted at the front of a vehicle, a rear window mounted at the rear of the vehicle, a side window mounted at the side of the vehicle and a window glass other than the vehicle window glass (for example, a building window glass, a ship window glass, and the like).

Figure 2:
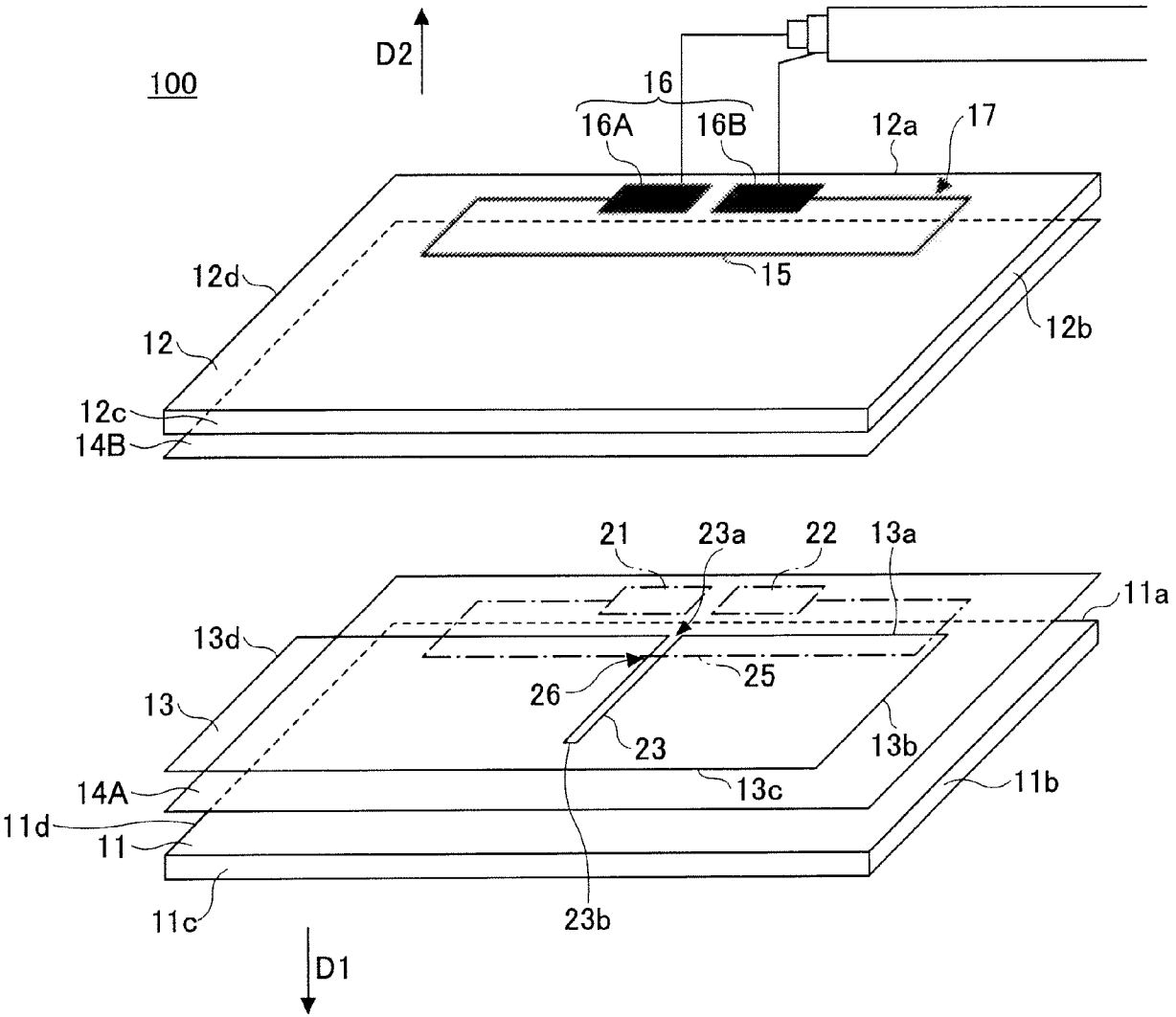
FIG. 2 is a disassembled perspective view of vehicle window glass 100 in a first embodiment of the present invention.

FIG. 2 is a disassembled perspective view of vehicle window glass 100 in a first embodiment of the present invention. The vehicle window glass 100 is a laminated glass formed by laminating a glass plate 11 that is an example of a first glass plate arranged on the vehicle exterior side D1, and a glass plate 12 that is an example of a second glass plate arranged on the vehicle interior side D2. The vehicle window glass 100 may be flat or may have a curved shape. FIG. 2 illustrates constituent elements of the vehicle window glass 100 in a state separated along a direction of a normal with respect to a surface of the glass plate 11 (or the glass plate 12).

The vehicle window glass 100 includes the glass plate 11, the glass plate 12, a conductive film 13, and an antenna conductor 17. The glass plate 12 is used as a dielectric that sandwiches the conductive film 13 with the first glass plate 11. The glass plate 11 and the glass plate 12 have the same size, and outer peripheral edges 11*a* through 11*d* of the glass plate 11 and outer peripheral edges 12*a* through 12*d* of the glass plate 12 have matching shapes when viewed in a direction (hereinafter referred to as a "laminating direction") in which the glass plate 12, the conductive film 13, and the glass plate 11 are laminated. An peripheral edge part 13*a* of the conductive film 13, that is interposed between the glass plate 11 and the glass plate 12, is offset by a predetermined distance in an in-plane direction from the outer peripheral edge 11*a* of the glass plate 11, and a slot 23, having a first end part 23*a* that opens at the peripheral edge part 13*a* of the conductive film 13, is formed. In addition, an antenna conductor 17 includes a loop-shaped antenna element 15, which a pair of electrodes 16 formed by electrodes 16A and 16B serve as a feeding point, on the glass plate 12 opposite to the conductive film 13.

The electrodes 16 are provided on a surface of the glass plate 12 opposite to the conductive film 13, at positions not overlapping the conductive film 13 when the electrodes 16 are projected onto the glass plate 11, that is, at positions closer to the outer peripheral edge 11*a* of the glass plate 11 than the peripheral edge part 13*a* of the conductive film 13. In other words, as illustrated in FIG. 2, the electrodes 16 are provided at positions such that, when the electrodes 16 are projected from the laminating direction, projections 21 and 22 of the electrodes 16 are formed at positions where the conductive film 13 is not formed.

The loop-shaped antenna element 15 is provided on the surface of the glass plate 12 on the opposite side from the conductive film 13, so as to intersect with the slot 23 in the laminating direction. In other words, as illustrated in FIG. 2, the loop-shaped antenna element 15 is provided at a position such that, when the loop-shaped antenna element 15 is projected from the laminating direction, a projection 25 of the loop-shaped antenna element 15 crosses the slot 23 and form a crossover part 26. When viewed from the laminating direction, the loop-shaped antenna element 15 and the slot 23 may cross at an angle of 90° or at an angle other than 90°. The loop shape of the loop-shaped antenna element 15 is not limited to a rectangular shape, and may have other polygonal shapes including a square shape and the like, a circular shape, and an oval shape.

According to such a configuration, when the electrodes 16 is fed, the loop-shaped antenna element 15 and the slot 23 that mutually cross in the laminating direction are electromagnetically coupled at the crossover part 26, to thereby excite a current flowing along the slot 23. As a result, compared to a case in which the slot 23 is not provided, an antenna gain may be improved. In addition, according to such a configuration, an operation at a predetermined frequency may be enabled regardless of the size of the slot between the conductive film and a flange of a vehicle body, and an antenna utilizing the conductive film may be realized without requiring accuracy in setting the glass plate to the flange of the vehicle body.

Next, a more detailed description will be given of the embodiment of the present invention. The vehicle window glass 100 illustrated in FIG. 2 has a laminated structure in which the conductive film 13 is laminated between the glass plate 11 and the glass plate 12.

An intermediate film 14A is arranged between the glass plate 11 and the conductive film 13, and an intermediate film 14B is arranged between the conductive film 13 and the glass plate 12. The glass plate 11 and the conductive film 13 are bonded by the intermediate film 14A, and the conductive film 13 and the glass plate 12 are bonded by the intermediate film 14B. The intermediate films 14A and 14B are formed from thermoplastic polyvinyl butyral, for example. A relative permittivity $\in_r$ of the intermediate films 14A and 14B is 2.8 or higher and 3.0 or lower, which is the relative permittivity of a general intermediate film of laminated glass, for example.

The glass plates 11 and 12 are formed from a transparent plate-shaped dielectric. In addition, one of the glass plates 11 and 12 may be semitransparent, and both of the glass plates 11 and 12 may be semitransparent.

Figure 4A:
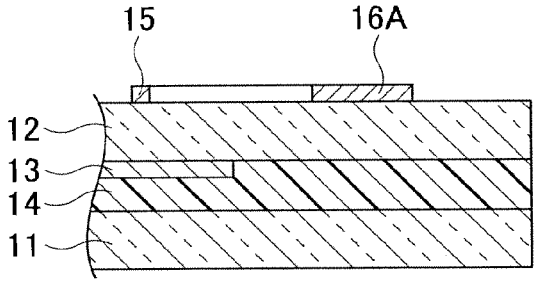
FIG. 4A is a cross sectional view illustrating a state in which a conductive film 13 is coated on a glass plate 12.

The conductive film 13 is a heat reflecting film capable of reflecting heat from the outside. The conductive film 13 may be transparent or semitransparent. For example, the conductive film 13 may be a conductive film formed on a surface of a film-shaped polyethylene terephthalate, or a conductive film formed on a surface of a glass plate, as illustrated in FIGS. 4A, 4C, and 4D. In addition, the conductive film 13 may be a conductive film adhered on the surface of the glass plate, as illustrated in FIG. 4E. The slot 23 has the open end (first end part) 23*a* at the peripheral edge part 13*a* of the conductive film 13.

The slot 23 is formed from the peripheral edge part 13*a* of the conductive film 13 towards the in-plane direction. The peripheral edge part 13*a* forms an outer peripheral edge of the conductive film 13. For example, the slot 23 may be formed by linearly cutting out the conductive film 13 from the open end 23*a* to a tip end (second end part) 23*b*.

In addition, the pair of electrodes 16 formed by the electrode 16A and the electrode 16B is arranged on the opposite side with respect to the position of the conductive film 13 via the glass plate 12. The electrodes 16 are exposed at the surface (that is, the surface on the opposite side with respect to the surface opposing the conductive film 13) on the vehicle interior side D2 of the glass plate 12, so that when the electrodes 16 are projected from the laminating direction, the projections 21 and 22 of the electrodes 16 are located at positions closer to the outer peripheral edge 11*a* of the glass plate 11 than the peripheral edge part 13*a* of the conductive film 13. The electrodes 16A and 16B are arranged side by side in a direction perpendicular to a longitudinal direction of the slot 23 and parallel to the surface of the glass plate 12. The positional relationship of the electrode 16A and the electrode 16B is not limited to the above. For example, the electrodes 16A and 16B may be arranged in an up and down direction (that is, the direction parallel to the longitudinal direction of the slot 23 in FIG. 2). When the electrodes 16 are viewed from the laminating direction, an intermediate part between the electrodes 16A and 16B may be located at a position on an extension of the longitudinal direction of the slot 23, or the intermediate part may be offset with respect to the extension.

Moreover, the loop-shaped antenna element 15 and the electrodes 16 are arranged on the same surface of the glass plate 12. The loop-shaped antenna element 15 is connected to the electrodes 16. In other words, the antenna conductor 17 forms a so-called loop antenna of dipole type together with the loop-shaped antenna element 15 and the electrodes 16 provided on the glass plate 12.

For example, in a case in which the electrode 16A is used as a signal line electrode and the electrode 16B is used as a ground line electrode, the electrode 16A is electrically connected to a signal line that is connected to a signal processing unit (for example, an amplifier and the like) that is mounted in the vehicle, and the electrode 16B is electrically connected to the ground line that is connected to a grounding part of the vehicle. For example, the grounding part may be the ground of the vehicle body, the ground of the signal processing unit to which the signal line connected to the electrode 16A connects, and the like. The electrode 16A may be used as the ground line electrode, and the electrode 16B may be used as the signal line electrode.

Reception signals of radio waves, corresponding to the current excited along the slot 23 and the current excited in the loop-shaped antenna element 15, are transmitted to the signal processing unit mounted in the vehicle via conductive members that are electrically connected to the pair of electrodes 16. Preferably, the conductive members are feeders, such as AV cables (low-voltage electric cables for automobiles) and coaxial cables.

In a case in which the coaxial cable is used as the feeders to feed to the antenna via the electrodes 16A and 16B, an inner conductor of the coaxial cable is electrically connected to the electrode 16A, and an outer conductor of the coaxial cable is electrically connected to the electrode 16B. In addition, a configuration may be employed in which connectors for electrically connecting the electrodes 16A and 16B to the conductive members, such as cables, that are connected to the signal processing unit, are mounted on the electrodes 16A and 16B. By use of such connectors, the mounting of the inner conductor of the coaxial cable to the electrode 16A is facilitated, and the mounting of the outer conductor of the coaxial cable to the electrode 16B is facilitated. Further, a configuration may be employed in which conductive members in the form of conductive projections are provided on the electrodes 16A and 16B, and the conductive projections fit into and make contact with feeding parts provided in a flange of the vehicle body to which the window glass 100 is mounted.

The shape of the electrode 16A and the electrode 16B and the separation between the electrodes 16A and 16B may be determined by taking into consideration the shapes of the conductive members or the connectors and the separation of the mounting surfaces. For example, a quadrate and a polygonal shape, such as a square shape, an approximately square shape, a rectangular shape, an approximately rectangular shape and the like, are preferable electrode shapes in view of mounting. Round shapes, such as a circular shape, an approximately circular shape, an oval shape, an approximately oval shape and the like are also preferable electrode shapes.

In addition, the antenna conductor 17, including the electrodes 16A and 16B and the loop-shaped antenna element 15, may be formed by printing and baking a paste that includes a conductive metal, for example a silver past, onto the surface of the glass plate 12 on the vehicle interior side D2. The method of forming the antenna conductor 17 is not limited to this method, and for example, a strips or films made of a conductive material such as copper and the like may be formed on the surface of the glass plate 12 on the vehicle interior side D2, and the conductive material may be adhered on the glass plate 12 by an adhesive or the like.

In addition, the antenna conductor 17 may be provided on a surface of a synthetic resin film, and the conductive film 13 formed with the slot 23 may be provided on the other surface of the synthetic resin film, in order to form a glass antenna. Moreover, a substrate such as a flexible substrate and the like may be used in place of the synthetic resin film. Such a glass antenna may be used by mounting the glass antenna on the surface of the glass plate 12 on the vehicle interior side D2 or on the vehicle exterior side D1.

Figure 3:
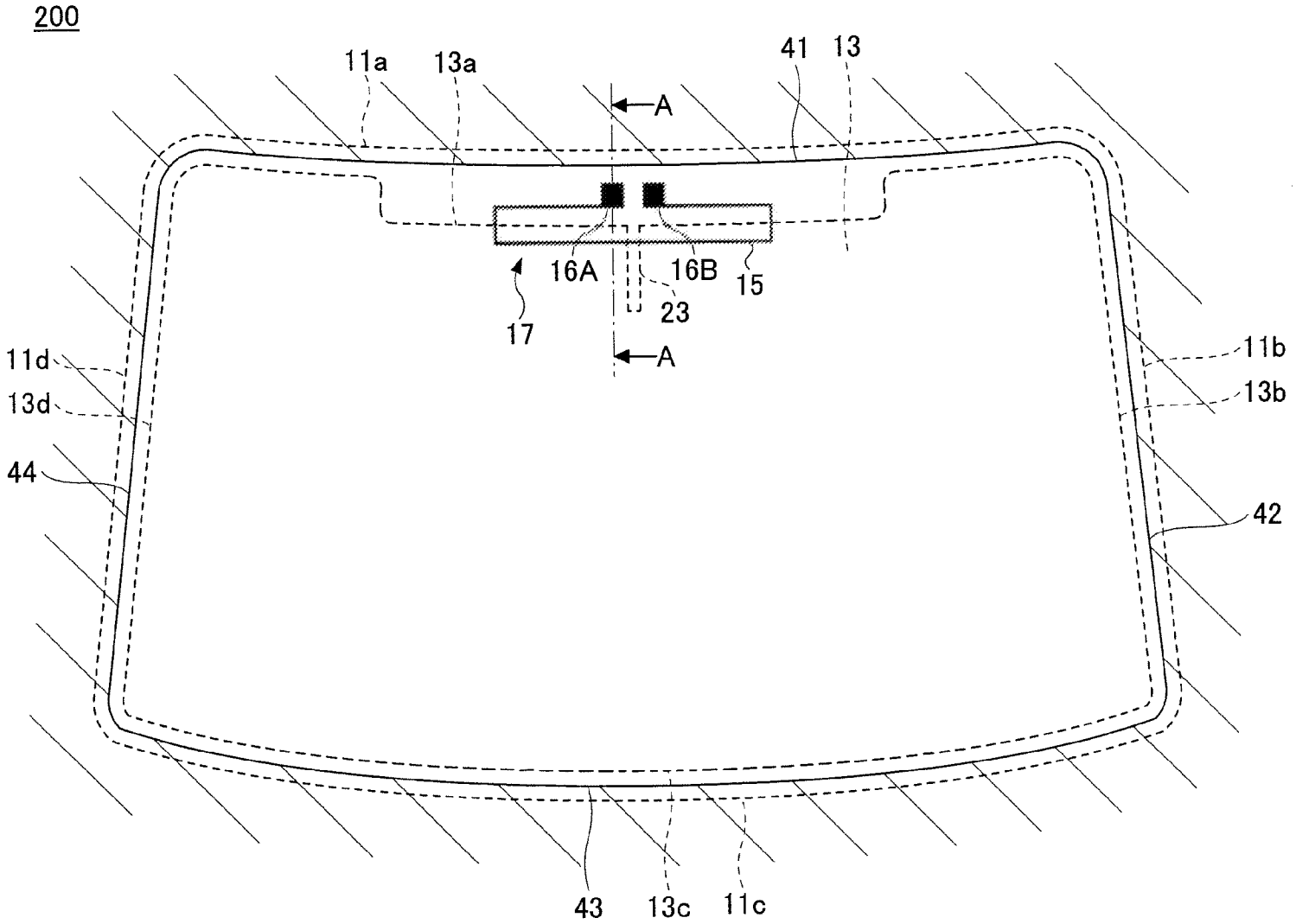
FIG. 3 is a front view (viewed within vehicle) of vehicle window glass 200 in a second embodiment of the present invention.

Further, the position of the loop-shaped antenna element 15 on the glass plate is not limited to a particular position as long as the position is suited for receiving radio waves in a predetermined frequency band. For example, the antenna in the embodiment may be arranged in a vicinity of a vehicle body opening edge that is a mounting part to which the vehicle window glass is mounted. As illustrated in FIG. 3, it may be preferable from the point of view of improving the antenna gain when the antenna is arranged in a vicinity of a vehicle body opening edge 41 on the vehicle roof side. In addition, the antenna may be arranged at a position moved to the right or left from the position illustrated in FIG. 3, to a vicinity of a vehicle body opening edge 42 or 44 on the vehicle body pillar side. Moreover, the antenna may be arranged at a position in a vicinity of a vehicle body opening edge 43 on the vehicle body chassis side. In the example illustrated in FIG. 3, the longitudinal direction of the slot 23 is perpendicular to the vehicle body opening edge 41, and matches a direction that is perpendicular to the peripheral edge part 13*a* of the conductive film 13.

FIG. 3 is a front view (viewed within vehicle) of vehicle window glass 200 in a second embodiment of the present invention. FIG. 3 illustrates a state in which the vehicle window glass 200 is mounted in the vehicle body opening. The vehicle window glass 200 is a laminated glass having a configuration similar to that illustrated in FIG. 2. The vehicle window glass 200 is mounted on a flange, which is a window frame formed on the vehicle body, using adhesive or the like. The vehicle opening edges 41 through 44 also form flange peripheral edge parts. The glass plate 12 having the same size as the glass plate 11 is used as the dielectric that sandwiches the conductive film 13 with the glass plate 11. From the point of view of improving the antenna gain, a mounting angle of the window glass with respect to the vehicle is preferably 15° to 90°, and more preferably 30° to 90°, with respect to a horizontal plane (ground plane).

The peripheral edge parts 13*a* through 13*d* forming the outer peripheral edges of the conductive film 13 are offset by the predetermined distance towards the inside from the outer peripheral edges 11*a* through 11*d* of the glass plate 11. By providing such an offset, the conductive film 13 may be prevented from corrosion caused by immersion and the like from matching surfaces of the glass plate 11 and the glass plate 12. In addition, in the example illustrated in FIG. 3, a recess is formed at the top peripheral edge part 13*a* of the conductive film 13, in a region where the conductive film 13 is receded towards the in-plane side and is not formed. The slot 23 is formed from a boundary line of this recess, and the electrodes 16 are provided in regions of the glass plate 12 corresponding to this recess. According to this configuration of the embodiment, the region where the antenna is to be formed may be secured even in a case in which the conductive film 13 is formed to a vicinity of the outer peripheral edge of the glass plate 11. The antenna may also be formed without providing the recess in the conductive film 13.

A concealing film may be formed on the glass plate 12, and a part or all of the antenna conductor 17 may be provided on this concealing film. Alternatively, a concealing film may be formed on the glass plate 11 in a region corresponding to a part or all of the antenna conductor 17. The part of the antenna conductor 17 is preferably a part of the loop-shaped antenna element 15 and the electrodes 16. For example, a ceramic film such as a black ceramic film and the like may be used as the concealing film. In this case, when viewed from the vehicle exterior side D1 of the vehicle window glass 200, the part of the antenna conductor provided on the concealing film is either not visible or difficult to identify due to the concealing film, to thereby improve the design of the window glass. In the example illustrated in FIG. 3, it may be preferable to provide the concealing film to cover the entire region corresponding to the recess, from the point of view of shielding heat wave by the concealing film, in place of the conductive film 13.

FIGS. 4A through 4E are cross sectional views of the vehicle window glass 200 along a line A-A in FIG. 3. FIGS. 4A through 4E illustrate variations of the laminated configuration employed by the vehicle window glass and the antenna in the embodiments. As illustrated in FIGS. 4A through 4E, the conductive film 13 is arranged between the glass plate 11 and the dielectric (that is, the glass plate 12 or the dielectric substrate 32). The conductive film 13 makes contact with a bonding layer between the glass plate and the dielectric.

Figure 4B:
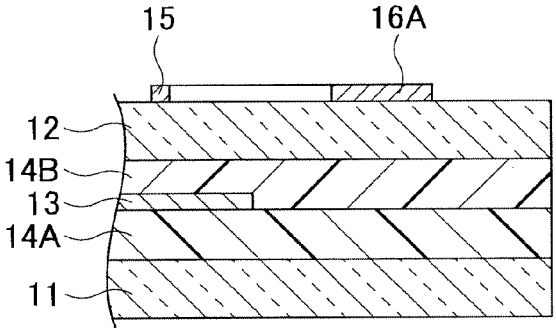
FIG. 4B is a cross sectional view illustrating a state in which the conductive film 13 is interposed between an intermediate film 14A and an intermediate film 14B.
Figure 4C:
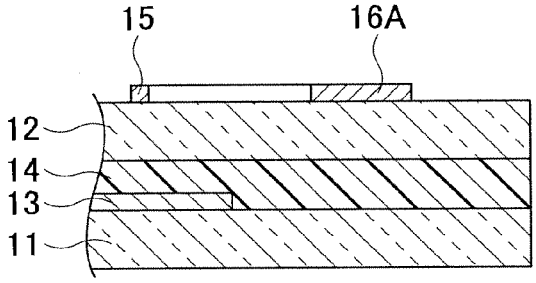
FIG. 4C is a cross sectional view illustrating a state in which the conductive film 13 is coated on a glass plate 11.
Figure 4D:
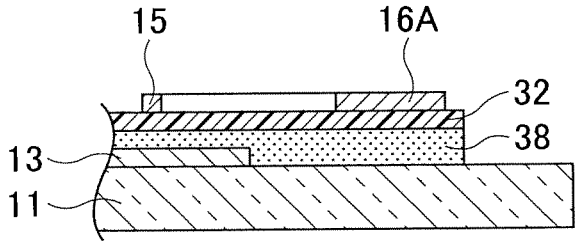
FIG. 4D is a cross sectional view illustrating a state in which the conductive film 13 between the glass plate 11 and a dielectric substrate 32 is coated on the glass plate 11.
Figure 4E:
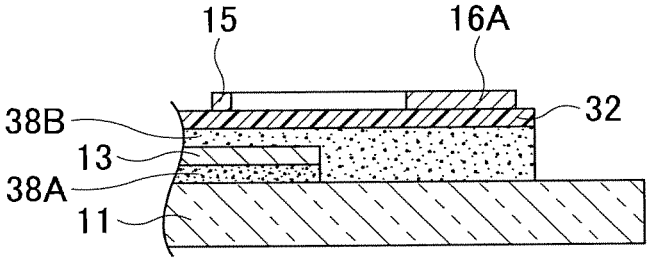
FIG. 4E is a cross sectional view illustrating a state in which the conductive film 13 between the glass plate 11 and the dielectric substrate 32 is bonded to the glass plate 11 by an adhesive 38A.

In the cases illustrated in FIGS. 4A through 4C, the conductive film 13 and the intermediate film 14 (or the intermediate films 14A and 14B) are arranged between the glass plate 11 and the glass plate 12. FIG. 4A illustrates a state in which the conductive film 13 is coated on the glass plate 12, by a deposition process that deposits the conductive film 13 on the surface of the glass plate 12 opposing the glass plate 11. FIG. 4B illustrates a state in which the film-shaped conductive film 13 is interposed between the intermediate film 14A, which makes contact with the surface of the glass plate 11 opposing the glass plate 12, and the intermediate film 14B, which makes contact with the surface of the glass plate 12 opposing the glass plate 11. The film-shaped conductive film 13 may be coated on a film by a deposition process that deposits the conductive film 13. FIG. 4C illustrates a state in which the conductive film 13 is coated on the glass plate 11, by a deposition process that deposits the conductive film 13 on the surface of the glass plate 11 opposing the glass plate 12.

In addition, as illustrated in FIGS. 4D and 4E, the vehicle window glass in the embodiments does not need to be laminated glass. In this case, the dielectric does not need to have the same size as the glass plate 11, and the dielectric may be formed by a dielectric substrate or the like having a size that enables forming of the antenna conductor 17. In the cases illustrated in FIGS. 4D and 4E, the conductive film 13 is arranged between the glass plate 11 and the dielectric substrate 32. FIG. 4D illustrates a state in which the conductive film 13 is coated on the glass plate 11, by a deposition process that deposits the conductive film 13 on the surface of the glass plate 11 opposing the dielectric substrate 32. The conductive film 13 and the dielectric substrate 32 are bonded by an adhesive 38, and the glass plate 11 and the dielectric substrate 32 are bonded by the adhesive 38. FIG. 4E illustrates a state in which the conductive film 13 is bonded on the surface of the glass plate 11 opposing the dielectric substrate 32 by an adhesive 38A. The conductive film 13 and the dielectric substrate 32 are bonded by the adhesive 38A, and the glass plate 11 and the dielectric substrate 32 are bonded by an adhesive 38B. The dielectric substrate 32 may be formed by a resin substrate that is made of a resin, and may be provided with the electrodes 16 and the loop-shaped antenna element 15. The resin substrate may be a printed substrate having the electrodes 16 and the loop-shaped antenna element 15 printed thereon.

As may be seen from FIGS. 4A through 4E, the electrodes 16 are provided on the glass plate 12 or the dielectric substrate 32 at positions closer to the outer peripheral edge of the glass plate than the peripheral edge part of the conductive film 13 (so as not to overlap the conductive film 13 when viewed from the laminating direction).

Figure 5A:
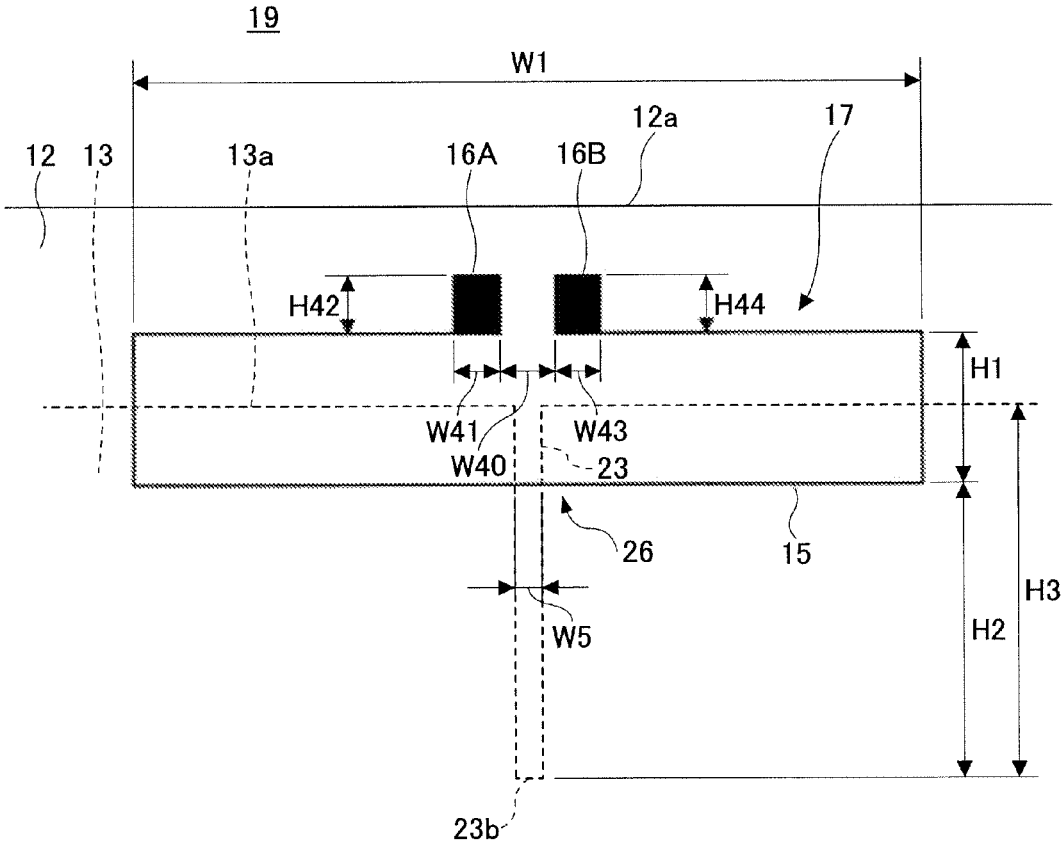
FIG. 5A is a front view of an antenna 19 illustrating an antenna part of FIGS. 2 and 3 on an enlarged scale.

FIG. 5A is a front view of an antenna 19 illustrating an antenna part of FIGS. 2 and 3 on an enlarged scale. The loop-shaped antenna element 15 has a shape and dimensions suited for receiving radio waves in a predetermined frequency band. The shape and dimensions of the loop-shaped antenna element 15 are not limited to particular values as long as the shape and dimensions are set to satisfy the required value of the antenna gain that is required to receive the radio waves in the predetermined frequency band.

When a wavelength in air at a center frequency of the predetermined frequency band of the loop-shaped antenna element 15 is denoted by $\lambda_0$, a shortening coefficient of wavelength for glass is denoted by k (where k=0.64), and $\lambda_g=\lambda_0 \cdot k$, preferable results may be obtained from the point of view of improving the antenna gain in the predetermined frequency band when a loop length L1 of the loop-shaped antenna element 15 (=H1×2+W1×2) is $\lambda_g$ or longer and $(7/5)\cdot\lambda_g$ or shorter. The loop length as used in the embodiments includes the separation between the electrodes 16A and 16B.

For example, in order to improve the antenna gain the predetermined frequency band having the center frequency of 310 MHz, and the velocity of the radio waves is $3.0\times10^8$ m/s, the loop length L1 of the loop-shaped antenna element 15 may be adjusted to 640 mm or longer and 900 mm or shorter.

In addition, when the slot length H2 from the crossover part 26 where the loop-shaped antenna element 15 and the slot 23 cross to the tip end 23*b* of the slot 23 is $(3/16)\cdot\lambda_g$ or longer and $(5/16)\cdot\lambda_g$ or shorter, preferable results may be obtained from the point of view of improving the antenna gain in the predetermined frequency band.

For example, in order to improve the antenna gain the predetermined frequency band having the center frequency of 310 MHz, and the velocity of the radio waves is $3.0\times10^8$ m/s, the slot length H2 may be adjusted to 120 mm or longer and 200 mm or shorter.

Figure 5B:
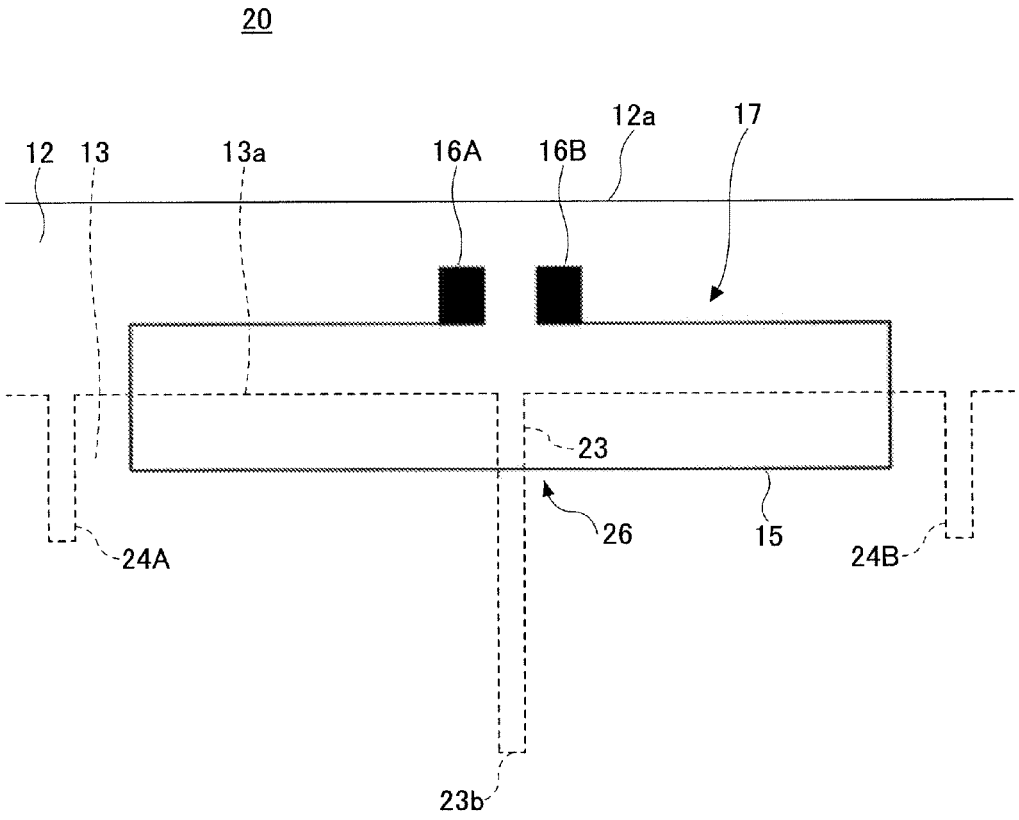
FIG. 5B is a front view of an antenna 20 in a third embodiment of the present invention.

FIG. 5B is a front view of an antenna 20 in a third embodiment of the present invention, including the dielectric 12, the conductive film 13, and the antenna conductor 17. As illustrated in FIG. 5B, other independent slots may be formed in the conductive film 13 at a position separated from the slot 23. Independent slots 24A and 24B are formed in the conductive film 13 and have one end thereof that opens at the peripheral edge part 13*a*, in a manner similar to the slot 23. The independent slots 24A and 24B are arranged on both sides of the slot 23 at positions separated from the slot 23, so that the projection of the loop-shaped antenna element 15 on the glass plate 11 does not intersect the slot 23. In addition, although not specifically illustrated, an independent slot that is not continuous with the slot 23 may be formed adjacent to the slot 23, so that this independent slot closes within the conductive film 13 without making contact with the outer peripheral edge of the conductive film 13. By providing such an independent slot, the band of the antenna may be broadened when compared to a case in which such an independent slot is not provided.

Practical Example 1

Numerical calculation was performed on a computer with respect to the antenna 19 of the embodiment illustrated in FIG. 5A, by assuming the window glass to be laminated glass formed by two glass plate 11 and 12 having a square shape with vertical and horizontal sides of 500 mm and a thickness of 2.0 mm that are bonded via two intermediate films 14A and 14B as illustrated in FIG. 4B. The pair of electrodes 16A and 16B are arranged on the surface, assumed to be on the vehicle interior side D2, of the glass plate 12, assumed to be on the vehicle interior side D2, and the conductive film 13 formed with the slot 23 is arranged between the two intermediate films 14A and 14B. The conductive film 13 has a size such that a vertical side is 250 mm and a horizontal side is 500 mm. The peripheral edge part 13*a* is set to pass a center along the up and down direction of the glass plate, and the slot 23 is set to pass a center along the right and left direction of the glass plate. The antenna conductor 17 is arranged so that the center along the right and left direction of the loop-shaped antenna element, the intermediate part between the electrodes 16A and 16B, and the extension along the longitudinal direction of the slot 23 match. It is assumed that the vehicle body and a defogger do not exist.

In addition, dimensions of each of the other parts are set as follows, where the units of the values are in mm.

H1: 48.75
H2: 163.125
H3: 187.5
W1: 341.25
W5: 6.0
W40: 10
W41, H42, W43, and H44: 20

Further, the following values are set.

Relative permittivity of glass plate: 7.0
Thickness per single intermediate film: 0.38 mm (15 mil)
Sheet resistance of conductive film 13: 2.0 [Ω]
Thickness of conductive film 13: 0.01 mm
Thickness of loop-shaped element 15 and electrode 16: 0.01 mm
Line width of loop-shaped element: 0.8 mm
Normalized impedance: 200 Ω

With respect to the antenna 19 set with these numerical values, an electromagnetic field simulation based on the FDTD method (Finite-Difference Time-Domain method) was made to perform numerical calculation of a return loss (reflection coefficient) (S11) for every 5 Hz in frequencies of 200 MHz to 400 MHz. The closer the S11 value is to zero the larger the return loss and the smaller the antenna gain, and the larger the negative value of the S11 the smaller the return loss and the larger the antenna gain.

Figure 6:
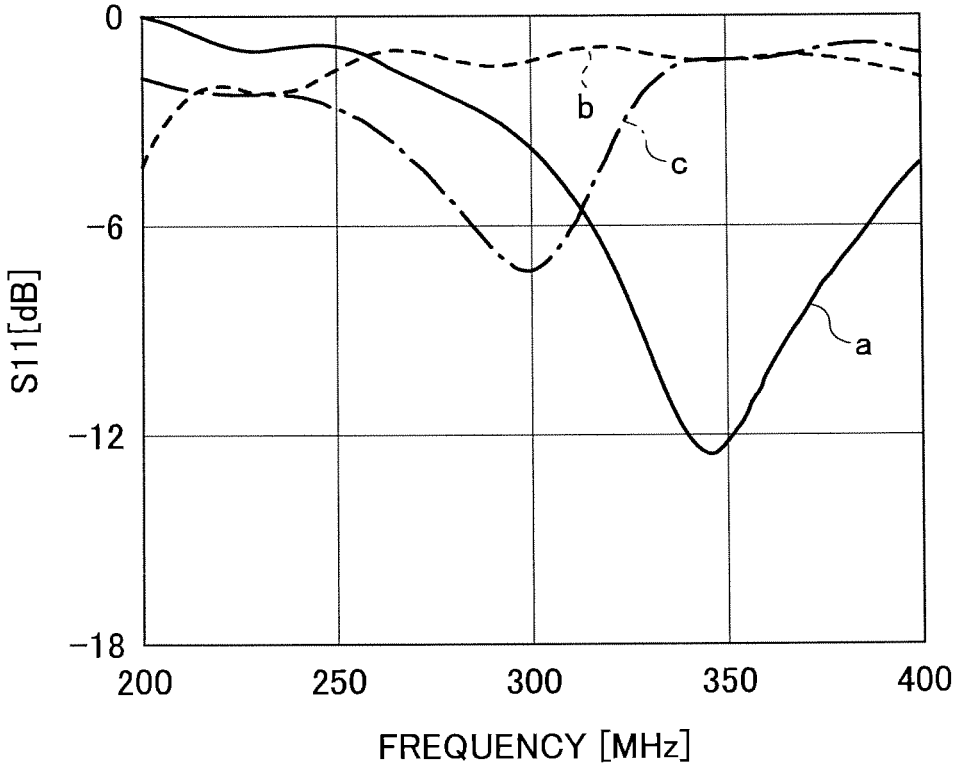
FIG. 6 is a graph illustrating an example of simulation results of a return loss (S11).

FIG. 6 is a graph illustrating an example of simulation results of the S11. In FIG. 6, "a" indicates the simulation results with respect to the embodiment of FIG. 5A when no conductive film 13 is provided, "b" indicates the simulation results with respect to the embodiment of FIG. 5A when no slot 23 is provided (conductive film 13 is provided), and "c" indicates the simulation results with respect to the embodiment of FIG. 5A.

As may be seen from a comparison of the simulation results for the case "a" and the case "b", the provision of the conductive film 13 not formed with the slot 23 will not enable an antenna function. However, by providing the slot 23 that crosses the loop-shaped antenna element 15 with respect to the case "b", the loop-shaped antenna element 15 and the slot 23 become electromagnetically coupled and a current may flow along the slot 23, to thereby enable satisfactory matching in a vicinity of 300 MHz as indicated in the case "c" and enable the antenna function.

Hence, according to the configuration described above, an antenna utilizing a conductive film may be configured without using a slot between a flange of a vehicle body and the conductive film. Because the flange of the vehicle body is not utilized, accuracy in setting a glass plate to the flange of the vehicle body may not be required. In addition, since it is unnecessary to form a hole in the glass plate and it is unnecessary to provide a feeding conductor that uses a detour route on an outer side of the outer peripheral edge of the glass plate, the antenna utilizing the conductive film may be realized with a simple configuration.

According to the embodiments, it is possible to realize an antenna utilizing a conductive film, that enables operation at a predetermined frequency regardless of the size of the slot between the conductive film and the flange of the vehicle body, and does not require accuracy in setting a glass plate to the flange of the vehicle body.

The embodiments may preferably be utilized as an antenna for an automobile to receive digital terrestrial television broadcasting, analog television broadcasting in the UHF band, digital television broadcasting in the United States, digital television broadcasting in the European Union states, or digital television broadcasting in the People's Republic of China, for example. Other usages of the antenna may include the FM broadcasting band (76 MHz to 90 MHz) in Japan, the FM broadcasting band (88 MHz to 108 MHz) in the U. S., television VHF bands (90 MHz to 108 MHz, 170 MHz to 222 MHz), or keyless entry system (300 MHz to 450 MHz) for vehicles, for example.

In addition, other usages may include communication in the 800 MHz band (810 MHz to 960 MHz) for mobile phones, the 1.5 GHz band (1.429 GHz to 1.501 GHz) for mobile phones, GPS (Global Positioning System) (the satellite GPS signal: 1575.42 MHz), and the VICS (registered trademark) (Vehicle Information and Communication System: 2.5 GHz).

Furthermore, other usages may include communication in the ETC (Electronic Toll Collection system: non-stop automatic toll collection system) communication (transmission frequency of road side wireless device: 5.795 GHz or 5.805 GHz, reception frequency of road side wireless device: 5.835 GHz or 5.845 GHz), the DSRC (Dedicated Short Range Communication, 915 MHz band, 5.8 GHz band, 60 GHz band), the microwave communication (1 GHz to 3 THz), the millimeter-wave communication (30 GHz to 300 GHz), and the SDARS (Satellite Digital Audio Radio Service, 2.34 GHz, 2.6 GHz).

The vehicle window glass and the antenna are described above with reference to the embodiments, however, it may be apparent to those skilled in the art that the present invention is not limited to the above embodiments, and various variations and modifications may be made without departing from the spirit and scope of the present invention.

What is claimed is:

1. Window glass for vehicle, comprising:
a glass plate;
a dielectric;
a conductive film arranged between the glass plate and the dielectric; and an antenna conductor having electrodes provided on a surface of the dielectric on a side opposite from the conductive film, wherein the conductive film is formed with a slot having a first end part that opens at a peripheral edge part of the conductive film, the antenna conductor includes a loop-shaped antenna element which the electrodes serve as a feeding point, projections of the electrodes on a side of the glass plate are located at positions not overlapping the conductive film, and a projection of the loop-shaped antenna element on the side of the glass plate forms a crossover part that crosses the slot.

2. The window glass for vehicle as claimed in claim 1, wherein the dielectric is formed by an other glass plate different from the glass plate.

3. The window glass for vehicle as claimed in claim 2, further comprising:

an intermediate film between the glass plate and the other glass plate.

4. The window glass for vehicle as claimed in claim 3, wherein the intermediate film is arranged in at least one of a position between the glass plate and the conductive film or a position between the other glass plate and the conductive film.

5. The window glass for vehicle as claimed in claim 1, wherein the dielectric is a film-shaped or plate-shaped body.

6. The window glass for vehicle as claimed in claim 1, wherein, when a wavelength in air at a center frequency of a predetermined frequency band is denoted by $\lambda_0$, a shortening coefficient of wavelength for glass is denoted by k (where k=0.64), and $\lambda_g=\lambda_0 \cdot k$, a loop length of the loop-shaped antenna element is $\lambda_g$ or longer and $(7/5)\cdot\lambda_g$ or shorter.

7. The window glass for vehicle as claimed in claim 1, wherein a loop length of the loop-shaped antenna element is 640 mm or longer and 900 mm or shorter.

8. The window glass for vehicle as claimed in claim 1, wherein, when a wavelength in air at a center frequency of a predetermined frequency band is denoted by $\lambda_0$, a shortening coefficient of wavelength for glass is denoted by k (where k=0.64), and $\lambda_g=\lambda_0 \cdot k$, a slot length of the slot from the crossover part to a second end part opposite to the first end part of the slot is $(3/16)\cdot\lambda_g$ or longer and $(5/16)\cdot\lambda_g$ or shorter.

9. The window glass for vehicle as claimed in claim 1, wherein a slot length from the crossover part to a second end part of the slot opposite to the first end part is 120 mm or longer and 200 mm or shorter.

10. The window glass for vehicle as claimed in claim 1, wherein the conductive film is formed with an other slot at positions separated from the slot.

11. An antenna comprising:

a glass plate;

a dielectric;

a conductive film arranged between the glass plate and the dielectric; and an antenna conductor having electrodes provided on a surface of the dielectric on a side opposite from the conductive film, wherein the conductive film is formed with a slot having a first end part that opens at a peripheral edge part of the conductive film, the antenna conductor includes a loop-shaped antenna element which the electrodes serve as a feeding point, projections of the electrodes on a side of the glass plate are located at positions not overlapping the conductive film; and a projection of the loop-shaped antenna element on the side of the glass plate forms a crossover part that crosses the slot.

12. The antenna as claimed in claim 11, wherein the dielectric is formed by an other glass plate different from the glass plate.

13. The antenna as claimed in claim 12, further comprising:

an intermediate film between the glass plate and the other glass plate.

14. The antenna as claimed in claim 13, wherein the intermediate film is arranged in at least one of a position between the glass plate and the conductive film or a position between the other glass plate and the conductive film.

15. The antenna as claimed in claim 11, wherein the dielectric is a film-shaped or plate-shaped body.

16. The antenna as claimed in claim 11, wherein, when a wavelength in air at a center frequency of a predetermined frequency band is denoted by $\lambda_0$, a shortening coefficient of wavelength for glass is denoted by k (where k=0.64), and $\lambda_g=\lambda_0 \cdot k$, a loop length of the loop-shaped antenna element is $\lambda_g$ or longer and $(7/5)\cdot\lambda_g$ or shorter.

17. The antenna as claimed in claim 11, wherein a loop length of the loop-shaped antenna element is 640 mm or longer and 900 mm or shorter.

18. The antenna as claimed in claim 11, wherein, when a wavelength in air at a center frequency of a predetermined frequency band is denoted by $\lambda_0$, a shortening coefficient of wavelength for glass is denoted by k (where k=0.64), and $\lambda_g=\lambda_0 \cdot k$, a slot length of the slot from the crossover part to a second end part opposite to the first end part of the slot is $(3/16)\cdot\lambda_g$ or longer and $(5/16)\cdot\lambda_g$ or shorter.

19. The antenna as claimed in claim 11, wherein a slot length from the crossover part to a second end part of the slot opposite to the first end part is 120 mm or longer and 200 mm or shorter.

20. The antenna as claimed in claim 11, wherein the conductive film is formed with an other slot at positions separated from the slot.

* * * * *